US008886349B2

(12) United States Patent
Hyoudo et al.

(10) Patent No.: US 8,886,349 B2
(45) Date of Patent: Nov. 11, 2014

(54) METHOD OF SUPPLYING MOLTEN METAL TO AUTOMATIC POURING MACHINE AND EQUIPMENT THEREFOR

(75) Inventors: Toshiyuki Hyoudo, Nagoya (JP); Tadashi Nishida, Nagoya (JP)

(73) Assignees: Sintokogio, Ltd., Aichi (JP); Fujiwa Denki Co., Ltd., Aichi (JP)

( * ) Notice: Subject to any disclaimer, the term of this patent is extended or adjusted under 35 U.S.C. 154(b) by 513 days.

(21) Appl. No.: 13/378,491

(22) PCT Filed: Mar. 19, 2010

(86) PCT No.: PCT/JP2010/054812

§ 371 (c)(1),
(2), (4) Date: Feb. 24, 2012

(87) PCT Pub. No.: WO2010/146908

PCT Pub. Date: Dec. 23, 2010

(65) Prior Publication Data

US 2012/0150329 A1 Jun. 14, 2012

(30) Foreign Application Priority Data

Jun. 16, 2009 (JP) ..... 2009-142986
Jan. 8, 2010 (JP) ..... 2010-003149

(51) Int. Cl.
*G06F 19/00* (2011.01)
*B22D 41/12* (2006.01)
*B22D 47/02* (2006.01)

(52) U.S. Cl.
CPC ..... *B22D 41/12* (2013.01); *B22D 47/02* (2013.01)
USPC ..... 700/99; 164/80

(58) Field of Classification Search
CPC ..... B22D 41/12; B22D 46/00; B22D 47/02; B22D 35/04; G05B 15/02
USPC ..... 700/145, 146, 147, 99; 222/590, 591; 164/4, 1, 80, 130, 136
See application file for complete search history.

(56) References Cited

U.S. PATENT DOCUMENTS

| | | | | |
|---|---|---|---|---|
| 5,701,945 | A * | 12/1997 | McKibben et al. | 164/130 |
| 7,475,716 | B2 * | 1/2009 | Hunter et al. | 164/4.1 |
| 8,327,912 | B2 * | 12/2012 | Terada et al. | 164/136 |
| 2005/0209478 | A1 * | 9/2005 | Cammack et al. | 558/288 |
| 2008/0196856 | A1 * | 8/2008 | Terada et al. | 164/136 |

FOREIGN PATENT DOCUMENTS

| | | |
|---|---|---|
| JP | 01-262064 | 10/1989 |
| JP | 11-207458 | 8/1999 |
| JP | 2001-321924 A | 11/2001 |

OTHER PUBLICATIONS

International Search Report issued May 25, 2010 in corresponding International Application No. PCT/JP2010/054812.

* cited by examiner

*Primary Examiner* — Kidest Bahta
(74) *Attorney, Agent, or Firm* — Finnegan, Henderson, Farabow, Garrett & Dunner, L.L.P.

(57) ABSTRACT

A supplying molten metal to an automatic pouring machine and equipment therefor. The equipment can not only supply the molten metal into the automatic pouring machine corresponding to the molding speed of the high-speed molding machine, but it can also appropriately supply the molten metal to the automatic pouring machine, so that the quality of that molten metal in the pouring ladle matches that of the molten metal that is poured in the molds. After supplying a required quantity of alloy materials in a treating ladle, supplying the molten metal from the melting furnace into the treating ladle; transporting the pouring ladle to the treating ladle; pouring the molten metal from the treating ladle into the pouring ladle; and fixing the pouring ladle that received the molten metal to the automatic pouring machine.

10 Claims, 6 Drawing Sheets

METHOD OF SUPPLYING MOLTEN METAL TO AUTOMATIC POURING MACHINE AND EQUIPMENT THEREFOR

TECHNICAL FIELD

This invention relates to a method of supplying molten metal to an automatic pouring machine and equipment therefor. More specifically, it relates to a method suitable for supplying the molten metal to the automatic pouring machine and the equipment therefor wherein the molten metal is supplied to the automatic pouring machine based on the information of the number of molds made by a high-speed molding machine and based on the information of the pouring from the automatic pouring machine and the information of the pouring of the molten metal from a melting furnace, corresponding to the number of the molds, into which the molten metal is scheduled to be poured.

BACKGROUND TECHNOLOGY

Conventionally one example of equipment for casting that uses an automatic pouring machine comprises:

- an apparatus for transporting frames that transports a plurality of molding frames in line;
- an apparatus for transferring pouring boxes that attaches a pouring box to a molding frame;
- a carriage for a ladle for pouring molten metal that carries a pouring ladle that pours the molten metal in the molding frame;
- a holding furnace that holds the molten metal to be poured in the pouring ladle and that keeps it at a suitable temperature;
- an apparatus for supplying alloy materials that supplies alloy materials to the pouring ladle; and
- a device for control that controls each apparatus;

wherein the carriage for the ladle for pouring molten metal is, for example, designed to have a function to do the rounds of moving from a position where it receives alloy materials from the apparatus for supplying alloy materials to a position where it receives the molten metal from the holding furnace, and then to a position where it pours the molten metal in the molding frames that are placed on the apparatus for transporting frames (for example, Patent Document 1).

DOCUMENT IN THE RELATED TECHNICAL FIELD

Patent Document

Patent Document 1: Publication of Japanese patent application, Publication No. H11-207458

SUMMARY OF INVENTION

Problem to be Solved by the Invention

If the conventional equipment for casting such as the one seen above is combined with a high-speed molding machine that has a short tact time for molding of such as from a few seconds to tens of seconds, the time that can be spared for melting raw material in a melting furnace becomes shorter. Further, to appropriately control the temperature of the molten metal, the quantity of the molten metal in the ladle must be increased. Also, the number of molds that are waiting in line for the molten metal to be poured increases on a casting line for mold where the molding flasks, each having a molds inside, are forwarded from a molding machine. Further, to appropriately keep the molten metal in the pouring ladle, which molten metal has the same quality as that of the molten metal that is to be poured in the mold, is difficult such that sometimes the molten metal in the pouring ladle that was not used is even discarded.

In view of the problem the purpose of the present invention is to provide a method of supplying molten metal to an automatic pouring machine and equipment for supplying the molten metal to the automatic pouring machine wherein the equipment can not only supply the molten metal to the automatic pouring machine corresponding to the molding speed of the high-speed molding machine but can appropriately supply the molten metal to the automatic pouring machine, so that the quality of the molten metal in the pouring ladle matches that of the molten metal to be poured in the molds.

Means to Solve Problem

To solve the problem the invention of the method of supplying molten metal to the automatic pouring machine is directed to supplying the molten metal from the melting furnace to the pouring ladle of the automatic pouring machine, wherein the method comprises the steps of:

- after supplying the required quantity of alloy materials in a treating ladle that connects the melting furnace with the pouring ladle by transporting the molten metal from the melting furnace to the pouring ladle, supplying the molten metal from the melting furnace into the treating ladle and having the treating ladle stand by, which treating ladle holds the molten metal that was supplied to it;
- transporting the pouring ladle that was separated from the automatic pouring machine to the treating ladle that was kept standing by;
- pouring the molten metal from the treating ladle that was kept standing by into the pouring ladle; and
- fixing the pouring ladle that received the molten metal to the automatic pouring machine.

Effects of the Invention

The method of the present invention comprises the steps of;

- after supplying the required quantity of alloy materials in a treating ladle that connects the melting furnace with the pouring ladle by transporting the molten metal from the melting furnace to the pouring ladle, supplying the molten metal from the melting furnace into the treating ladle and having the treating ladle stand by, which treating ladle holds the molten metal that was supplied to it;
- transporting the pouring ladle that was separated from the automatic pouring machine to the treating ladle that was kept standing by;
- pouring the molten metal from the treating ladle into the pouring ladle, which treating ladle was kept standing by; and
- fixing the pouring ladle that received the molten metal to the automatic pouring machine.

So, the method of the present invention has, for example, the following advantageous effects:

- the equipment for supplying the molten metal to automatic pouring machine of the present invention can accurately pour the required quantity of molten metal from the treating ladle that is standing by into the pouring ladle;
- the equipment can pour the molten metal corresponding to the speed of molding of the high-speed molding machine and also it can supply the molten metal to the automatic pouring machine in a short time, so the quality of which molten metal in the pouring ladle matches that of the molten metal that is poured into the molds.

EMBODIMENT TO CARRY OUT THE INVENTION

Figure 1:
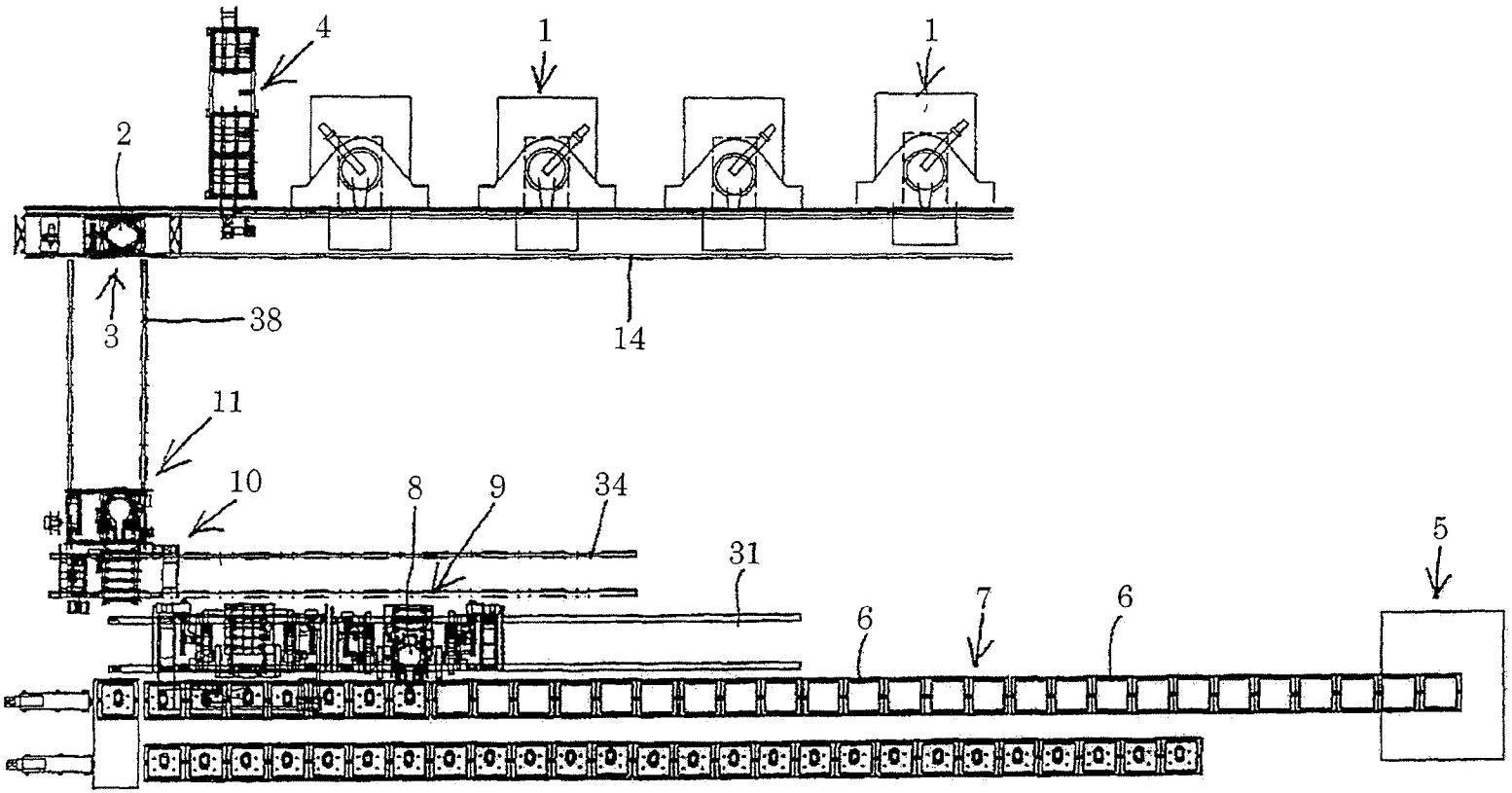
FIG. 1 is a plan view of an embodiment of the equipment for casting where the present invention is applied.

Below an embodiment of the equipment for casting where the present invention is applied is explained based on FIGS. 1 to 6. As shown in FIG. 1 the equipment for casting of the present invention comprises:

- the apparatus for supplying alloy materials 4 and a plurality of melting furnaces 1, 1 that run in a line from left to right parallel to the casting line for mold 7;
- the carriage for transporting treating ladle 3 that carries the treating ladle 2 to and from the position of each melting furnace 1, the treating ladle 2 receiving the molten metal from each melting furnace 1 and temporarily storing it;
- the apparatus for supplying alloy materials 4 that is disposed next to the melting furnace 1 on the far left and that supplies alloy materials to the treating ladle 2;
- the casting line for mold 7 comprising molding flasks 6 that each have a built-in mold and that are forwarded in a line from a molding machine 5;
- the automatic pouring machines 9 that are movable in coordinated movement with that of the group of molding flasks 6 of the casting line for mold 7 and have the pouring ladle 8, and automatically pour the molten metal in the mold;
- the first carriage for transporting pouring ladle 10 that can transport the pouring ladle 8 along the casting line for mold 7; and
- the second carriage for transporting pouring ladle 11 that transports the pouring ladle 8 between the carriage for transporting treating ladle 3 and the first carriage for transporting pouring ladle 10; and
- a device for control (not shown in Figs.) that controls each apparatus, etc.

To protect operators from the heat of the groups of melting furnaces 1, the equipment, apparatuses, etc. are placed at positions away from the group of melting furnaces 1.

Figure 2:
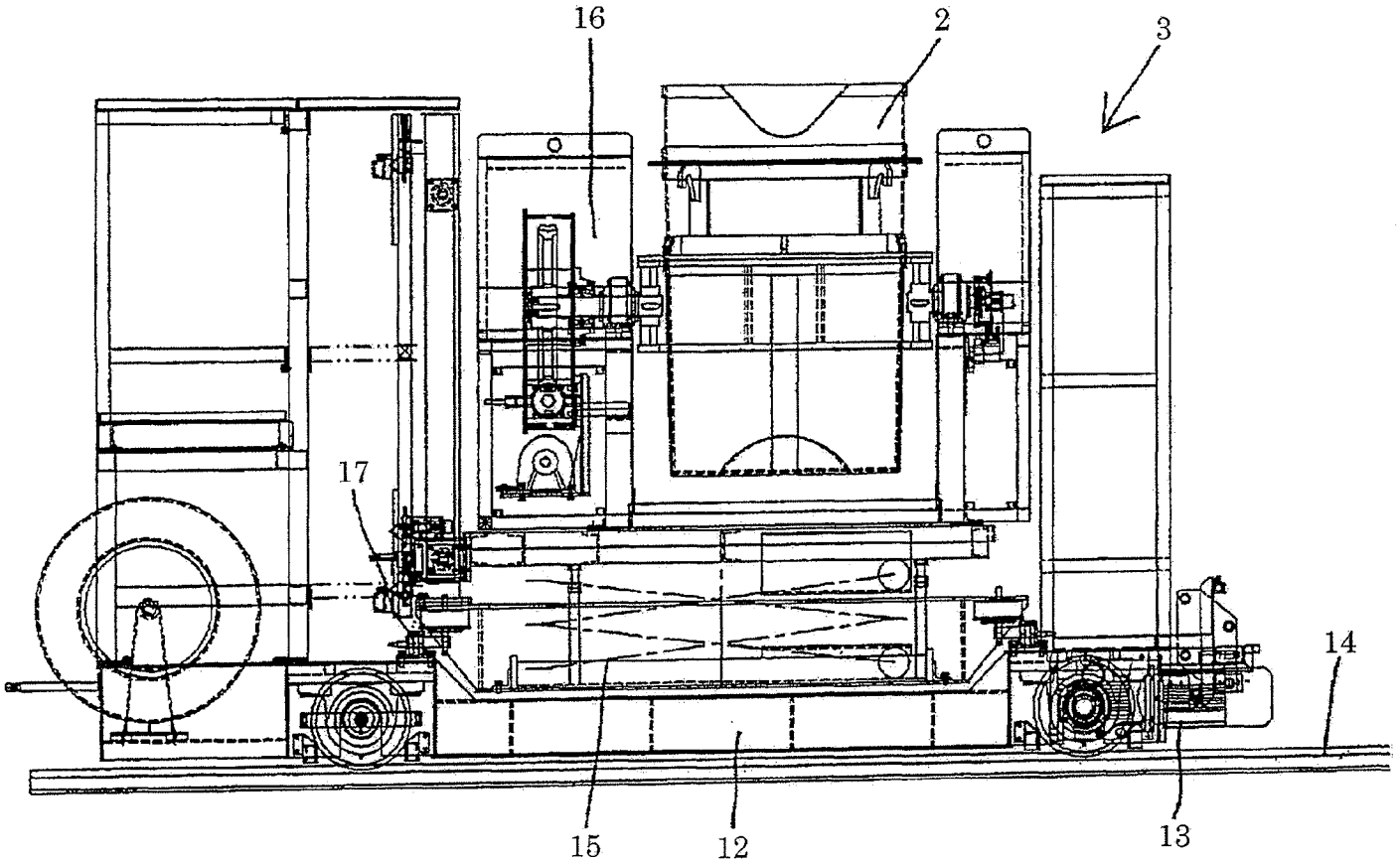
FIG. 2 is a front view of the carriage for transporting treating ladle, which is the main apparatus of the equipment for casting of FIG. 1.

As shown in FIG. 2, the carriage for transporting treating ladle 3 has a mechanism for driving wheels 13 attached to the carriage body 12. The carriage for transporting treating ladle 3 is movable on first rails 14 that are laid in FIG. 1 in front of the apparatus for supplying alloy materials 4 and the group of melting furnaces 1, driven by the mechanism for driving wheels 13. Also, as shown in FIG. 2, the treating ladle 2 that is on the carriage for transporting treating ladle 3 is attached to a hoisting mechanism 15 that is disposed on the carriage body 12, and that can move up and down. Also, the treating ladle 2 can be tilted by a tilting mechanism 16 that is attached to the hoisting mechanism 15. Further, the weight of the molten metal in the treating ladle 2 can be measured by a mechanism for measuring weight 17 that is attached to the carriage body 12.

Figure 3:
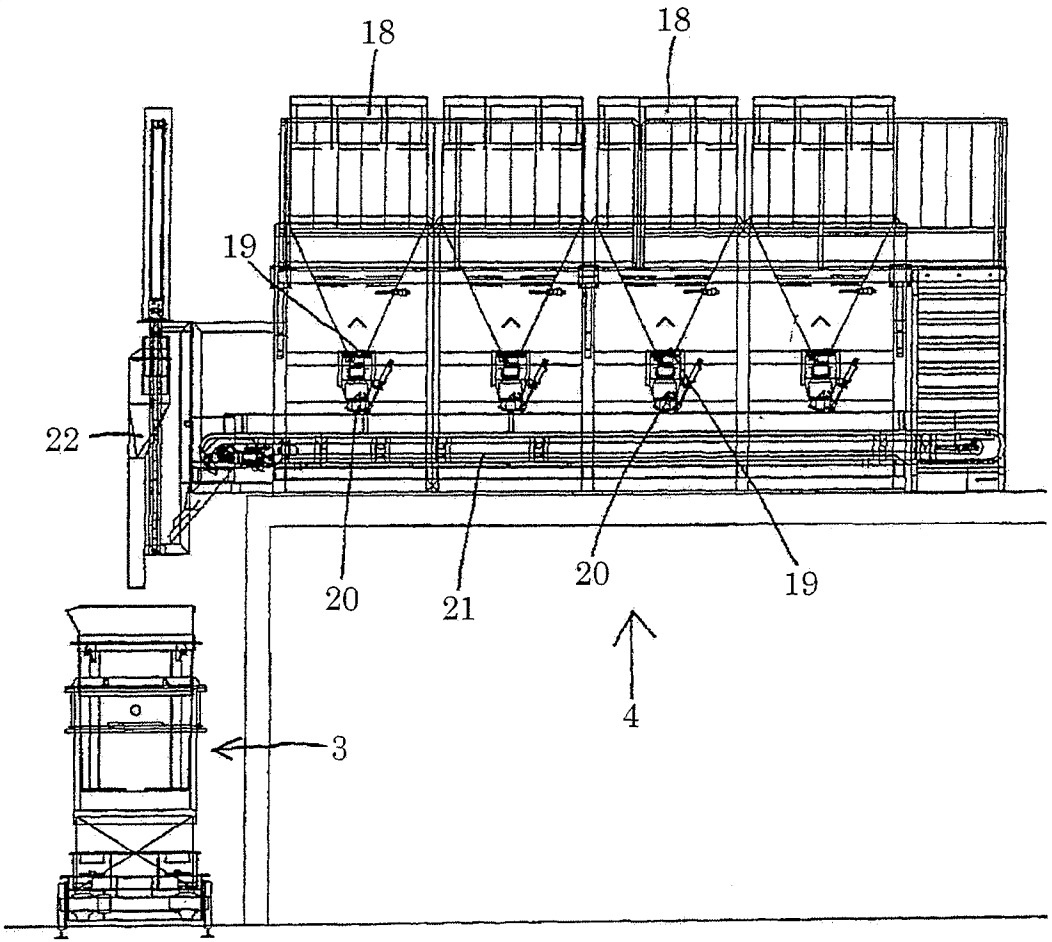
FIG. 3 is a side view of the apparatus for supplying alloy materials, which is the main apparatus of the equipment for casting of FIG. 1.

Further, as shown in FIG. 3, the apparatus for supplying alloy materials 4 has four hoppers 18, 18 that each contain a different kind of alloy material, wherein the mechanisms for measuring weight 19 are each attached to the outlet that is at the lower end of each hopper 18 and an opening and closing mechanism 20 is each attached to the lower surface of each of the mechanisms for measuring weight 19. A conveyor belt 21 is installed right below the four opening and closing mechanisms 20, and extends along them. A mechanism for supplying alloy materials 22 is installed at the position of discharge that is at the far-left end of the conveyor belt 21.

Figure 4:
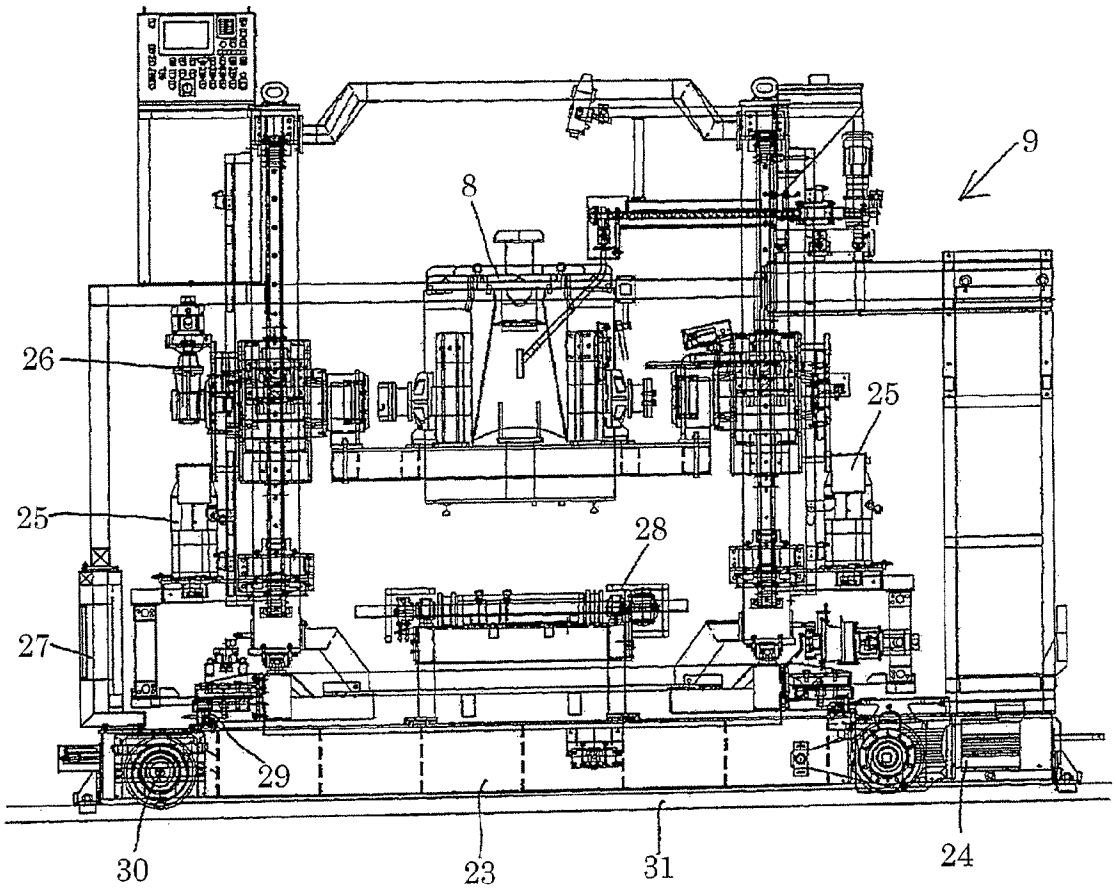
FIG. 4 is a front view of the automatic pouring machine which is the main apparatus of the equipment for casting of FIG. 1.

Further, as shown in FIG. 4, the automatic pouring machine 9 comprises:

- a carriage 23;
- a mechanism for driving wheels 24 that is attached to the carriage 23 and that drives the wheels of the carriage 23;
- a hoisting mechanism 25 that is attached to the carriage 23 and that can lift and lower the pouring ladle 8, the pouring ladle 8 being placed on the carriage 23 from which it is removable;

- a tilting mechanism 26 that is attached to the hoisting mechanism 25 and that can tilt the pouring ladle 8;
- a backward-and-forward moving mechanism 27 that is attached to the carriage 23 and that can move the hoisting mechanism 25 and the tilting mechanism 26 backward and forward;
- a mechanism for driving rollers 28 that is attached to the carriage 23 and that can move the pouring ladle 8 backward and forward;
- a mechanism for measuring weight 29 that is attached to the carriage 23 and that can measure the weight of the molten metal in the pouring ladle 8; and
- a mechanism for detecting position 30 that can detect the position of the pouring ladle 8 relative to the molding flasks 6 of the casting line for mold 7.

Driven by the mechanism for driving wheels 24 and as shown in FIG. 1, the automatic pouring machine 9 is movable on the rails 31 that are laid along the casting line for mold 7.

Figure 5:
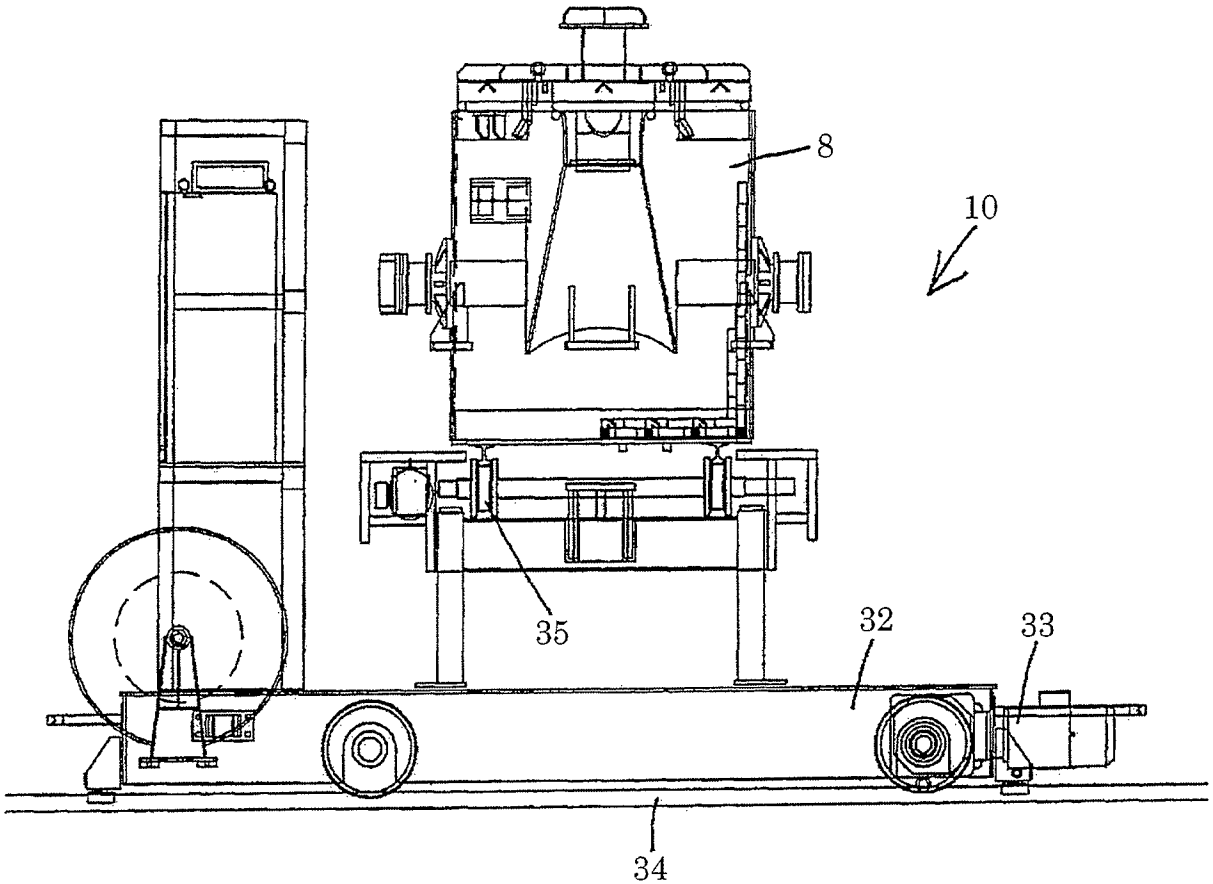
FIG. 5 is a front view of the first carriage for transporting pouring ladle which is the main apparatus of the equipment for casting of FIG. 1.

Also, as shown in FIG. 5, the first carriage for transporting pouring ladle 10 has a mechanism for driving wheels 33 that is attached to a carriage body 32. Driven by the mechanism for driving wheels 33, the first carriage for transporting pouring ladle 10 can move on second rails 34 that are laid in FIG. 1 along the group of automatic pouring machines 9 and at the back of the group of automatic pouring machines 9. Also, as shown in FIG. 5, driven by a mechanism for driving rollers 35 that is attached to the carriage body 32, the pouring ladle 8 can move backward and forward.

Figure 6:
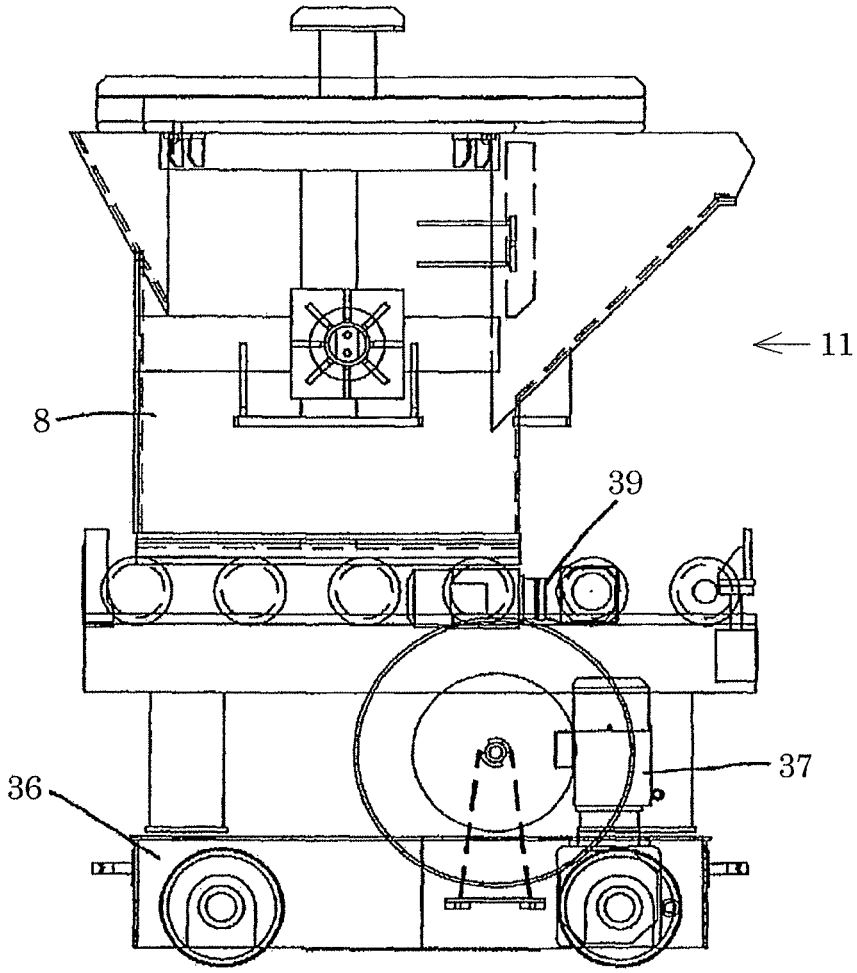
FIG. 6 is a left side view of the second carriage for transporting pouring ladle which is the main apparatus of the equipment for casting of FIG. 1.

Also, as shown in FIG. 6, a second carriage for transporting pouring ladle 11, which has a mechanism for driving wheels 37 attached to a carriage body 36, is movable, driven by the mechanism for driving wheels 37, on third rails 38 that are laid between the first rails 14 and the second rails 34 and in a direction that is perpendicular to the first rails 14 and to the second rails 34. The thirds rails 38 are laid in such a way that they connect the carriage for transporting treating ladle 3 and the first carriage for transporting pouring ladle 10. The pouring ladle 8, which is placed on driving rollers 39 that are attached to the carriage body 36 and which is removable from the driving rollers 39, is movable driven by the driving rollers 39 in the direction of the third rails 38. In this way the second carriage for transporting pouring ladle 11 can move backward and forward between the carriage for transporting treating ladle 3 and the first carriage for transporting pouring ladle 10, thereby transporting the empty pouring ladle 8 to the position of the carriage for transporting treating ladle 3. Also, the second carriage for transporting pouring ladle 11 can transport the pouring ladle 8, into which the molten metal is poured, from the position of the carriage for transporting treating ladle 3 to the position of the first carriage for transporting pouring ladle 10.

The equipment for casting thus constituted can be operated as follows: each of the mechanisms for measuring weight 19 and each of the opening and closing mechanisms 20 of the apparatus for supplying alloy materials 4 are operated whereby the predetermined amounts of alloy materials are dropped onto the conveyor belt 21. Then alloy materials 4 are supplied to the treating ladle 2 by the mechanism for supplying alloy materials 22. Next the treating ladle 2 that has the alloy materials 2 supplied is carried to the position of the melting furnace 1 by the second carriage for transporting treating ladle 3. There, to have an accurate ratio of the alloy materials to the molten metal, the amount of the molten metal that is to be supplied and the information of which amount is previously transmitted is supplied from the melting furnace 1 to the treating ladle 2, wherein supplying the amount of the molten metal is controlled by the mechanism for measuring weight 17 of the carriage for transporting treating ladle 3. Then the treating ladle 2 that holds the molten metal that was supplied is transported by the carriage for transporting treating ladle 3 to the position that faces the third rails 38 and is kept to stand by.

While the molten metal is supplied from the melting furnace 1 to the treating ladle 2, two automatic pouring machines 9, 9 each pour the molten metal into each mold on the casting line for mold 7, respectively.

That is, based on the results obtained by the mechanism for detecting position 30, the automatic pouring machines 9 each determine that the material of the molten metal to be poured into the mold that is opposite the respective automatic pouring machines, and the amount of the molten metal that is to be poured into the mold matches those of the molten metal in the pouring ladle 8. Then each automatic pouring machine 9 has the pouring ladle 8 pour into the mold the amount of the molten metal that is to be poured, while controlling the pouring by the mechanism for measuring weight 29 in a way that the movements of the hoisting mechanism 25, the tilting mechanism 26, and the backward-and-forward moving mechanism 27 are coordinated. In this way the pouring is repeated until the amount of the molten metal that remains in the pouring ladle 8 becomes less than one that can fill one mold. At this point that pouring ladle 8 is considered to have completed the pouring.

If the pouring ladle 8 has completed the pouring of the molten metal, the hoisting mechanism 25 lowers the pouring ladle 8 that has completed the pouring and places it on the mechanism for driving rollers 28. Then the pouring ladle 8 that has completed the pouring is transferred from the automatic pouring machine 9 onto the first carriage for transporting pouring ladle 10 in coordinated movements of the mechanism for driving rollers 28 and the driving rollers 35 of the first carriage for transporting pouring ladle 10. Next the pouring ladle 8 that has completed the pouring is transported by the first carriage for transporting pouring ladle 10 to the position that is opposite to the third rails 38 (the position that is the closest to the third rails 38). Then after the pouring ladle 8 that has completed the pouring is transferred from the first carriage for transporting pouring ladle 10 to the second carriage for transporting pouring ladle 11 in the coordinated movements of the driving rollers 35 and the driving rollers 39 of the second carriage for transporting pouring ladle 11, the pouring ladle 8 is transported by the second carriage for transporting pouring ladle 11 to the position where the carriage for transporting treating ladle 3 stands by.

Next, under the control of the mechanism for measuring weight 17 of the carriage for transporting treating ladle 3, the molten metal in the treating ladle 2 is poured into the pouring ladle 8 that has completed the pouring by having the treating ladle 2 tilted by the tilting mechanism 16 of the carriage for transporting treating ladle 3. Then the pouring ladle 8 that received the molten metal is returned by the second carriage for transporting pouring ladle 11 to the position where the first carriage for transporting pouring ladle 10 stands by. Next, the pouring ladle 8 that received the molten metal is transferred from the second carriage for transporting pouring ladle 11 to the first carriage for transporting pouring ladle 10 in the coordinated movements of the driving rollers 39, 35. Next the pouring ladle 8 is transferred from the first carriage for transporting pouring ladle 10 to the automatic pouring machine 9 in the coordinated movements of the driving rollers 35, 28. Then likewise the pouring ladle 8 on the automatic pouring machine 9 pours the molten metal into the molds of the casting line for mold 7.

In this way while the first automatic pouring machine 9 pours the molten metal in the molds, so as to supply the molten metal in the second automatic pouring machine 9, the device for control carries out the steps of calculating the molten metal, etc., by the following respective circuits.

Namely, when the molten metal in the treating ladle 2 is all poured into the pouring ladle 8 that has completed the pouring, a circuit of the device for control calculates (1) the number of molds that the molten metal that remains in the pouring ladle 8 of the second automatic pouring machine 9 that is pouring can fill and (2) the number of molds that the molten metal that the pouring ladle 8 that had completed the pouring of the molten metal received from the treating ladle 2 can fill. Then a circuit calculates the total number of molds that the molten metal can fill by adding the two numbers of molds that the molten metal can fill. Next a circuit determines if the total number of molds that the molten metal can fill exceeds the number of molds on the casting line for mold 7 that the molten metal is yet to fill.

If the total number of molds that the molten metal can fill is equal to or less than the number of molds in the casting line for mold 7 that the molten metal is yet to fill, based on the total quantity of the molten metal that is to be poured and the number of molds on the casting line for mold that the molten metal is yet to fill, a circuit calculates the amount of the molten metal that should be supplied from the melting furnace 1 to the treating ladle 2 that has completed the pouring. Based on the result of the calculation, a circuit determines the target amounts of the four alloy materials that should be supplied from the apparatus for supplying alloy materials 4 to the treating ladle 2 that has completed the pouring. Then the target amount is sent to the device for control of the apparatus for supplying alloy materials 4. Also, the target amount of the molten metal is sent to the control device of the carriage for transporting treating ladle 3.

A circuit determines if a change of material is necessary for the molten metal that is to be poured into the molds on the casting line for mold, which molds the molten metal is yet to fill. If a change of material is necessary, a circuit that calculates the amount of the molten metal recalculates the total amount of the molten metal that is to be poured before the change of material is carried out and after determining that the total amount is above the minimum amount of the molten metal that is scheduled to be poured, the circuit determines the target amounts for the four alloy materials.

If the total amount of the molten metal that is to be poured is less than the scheduled minimum amount of the molten metal that is to be poured, a circuit stops the step for pouring the molten metal from the treating ladle 2 to the pouring ladle 8.

If the total number of the molds that the molten metal can fill exceeds the number of the molds on the casting line for mold 7, which molds the molten metal is yet to fill, a circuit determines if the material of the molten metal that is to be poured into the scheduled number of molds of the next round, is the same as the material of the molten metal that is being poured.

If the material of the molten metal that is to be poured into the scheduled number of molds of the next round is the same as the material of the molten metal that is being poured, based on the amount of the molten metal that is to be poured and the number of molds that the molten metal is yet to fill, a circuit calculates the amount of the molten metal that is below the capacity of the pouring ladle 8. Based on the result of this calculation, a circuit determines the calculated amounts for four kinds of alloy materials that are to be supplied from the apparatus for supplying alloy materials 4 to the empty treating ladle 2.

The apparatus for supplying alloy materials 4 of the present invention as shown in the specification and drawings has four hoppers that each store alloy materials that are different from each other. But the number of the alloy materials is not limited to the four kinds. It can be increased or decreased depending on the need. Thus the number of the hoppers can also be adjusted accordingly.

If the material of the molten metal that is to be poured into the scheduled number of the molds of a next round differs from the material of the molten metal that is being poured, and after the circuit that determines the target amounts of the four alloy materials determines that the total amount of the molten metal that is to be poured exceeds the scheduled minimum total amount the molten metal that is to be poured, it determines target amounts for the four alloy materials.

If the total amount of the molten metal that is to be poured is within the scheduled minimum total amount of the molten metal that is to be poured, the circuit that stops the step of pouring the molten metal from the treating ladle 2 to the pouring ladle 8 stops the step.

In the above embodiment two automatic pouring machines 9 are used. However, if a wider area is available for the pouring of the molten metal and if a sufficient time can be secured for the pouring by synchronizing the operation of the apparatuses, the number of the automatic pouring machines can be reduced to one.

The present application is based on the Japanese Patent Applications, No. 2009-142986, filed Jun. 16, 2009 and No. 2010-003149, filed Jan. 8, 2010, which are hereby incorporated in their entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

SYMBOLS

1 melting furnace
2 treating ladle
3 carriage for transporting treating ladle
4. apparatus for supplying alloy materials
7 casting line for mold
8 pouring ladle
9 automatic pouring machine
10 first carriage for transporting pouring ladle
11 second carriage for transporting pouring ladle

The invention claimed is:

1. A method of supplying molten metal from a melting furnace to a pouring ladle of an automatic pouring machine, wherein the method comprises the steps of:

after supplying the required quantity of alloy materials in a treating ladle that connects the melting furnace with the pouring ladle by transporting the molten metal from the melting furnace to the pouring ladle, supplying the molten metal from the melting furnace into the treating ladle and having the treating ladle stand by, which treating ladle holds the molten metal that was supplied to it;

transporting the pouring ladle that was separated from the automatic pouring machine to the treating ladle that was kept standing by;

pouring the molten metal from the treating ladle into the pouring ladle, which treating ladle was kept standing by; and fixing the pouring ladle that received the molten metal to the automatic pouring machine.

2. A method of supplying molten metal from the melting furnace to the pouring ladle of the automatic pouring machine, according to claim 1, wherein while a first automatic pouring machine pours the molten metal in molds, so as to supply the molten metal in a second automatic pouring machine, the method comprises the following steps:

when the molten metal in the treating ladle is all poured into the pouring ladle that has completed the pouring, calculating (1) the number of molds that the molten metal that remains in the pouring ladle of the second automatic pouring machine that is pouring can fill and (2) the number of molds that the molten metal that the pouring ladle that had completed the pouring of the molten metal received from the treating ladle can fill;

calculating the total number of molds that the molten metal can fill by adding the two numbers of molds that the molten metal can fill;

determining if the total number of molds that the molten metal can fill exceeds the number of molds on the casting line for mold that the molten metal is yet to fill;

if the total number of molds that the molten metal can fill is equal to or less than the number of molds in the casting line for mold that the molten metal is yet to fill, based on the total quantity of the molten metal that is to be poured and the number of molds on the casting line for mold that the molten metal is yet to fill, calculating the amount of the molten metal that should be supplied from the melting furnace to the treating ladle that has completed the pouring;

based on the result of the calculation, determining the target amounts of the four alloy materials that should be supplied from the apparatus for supplying alloy materials to the treating ladle that has completed the pouring;

determining if a change of material is necessary for the molten metal that is to be poured into the molds on the casting line for mold, which molds the molten metal is yet to fill;

if the change of material is necessary, recalculating the total amount of the molten metal that is to be poured before the change of material is carried out and after determining that the total amount is above the minimum amount of the molten metal that is scheduled to be poured, determining the target amounts for the four alloy materials;

if the total number of the molds that the molten metal can fill exceeds the number of the molds on the casting line for mold, which molds the molten metal is yet to fill, determining if the material of the molten metal that is to be poured into the scheduled number of molds of the next round is the same as the material of the molten metal that is being poured;

if the material of the molten metal that is to be poured into the scheduled number of molds of the next round is the same as the material of the molten metal that is being poured, based on the amount of the molten metal that is to be poured and the number of molds that the molten metal is yet to fill, calculating the amount of the molten metal that is below the capacity of the pouring ladle;

based on the result of this calculation, determining the calculated amounts for four kinds of alloy materials that are to be supplied from the apparatus for supplying alloy materials to the empty treating ladle; and if the material of the molten metal that is to be poured into the scheduled number of the molds of the next round differs from the material of the molten metal that is being poured, determining the target amounts of the four alloy materials after determining that the total amount of the molten metal that is to be poured exceeds the scheduled minimum total amount the molten metal that is to be poured.

3. Equipment for supplying molten metal from a melting furnace to an automatic pouring machine, comprising:

a carriage for transporting a treating ladle that carries the treating ladle to and from the position of a melting furnace, the treating ladle receiving the molten metal from the melting furnace and temporarily storing it;

an apparatus for supplying alloy materials that is disposed next to the melting furnace and that supplies alloy materials to the treating ladle;

an automatic pouring machine that is movable in coordinated movement with the movements of the group of molding flasks of the casting line for mold comprising molding flasks that each have a built-in mold and that are forwarded in a line from a molding machine, the automatic pouring machine has a pouring ladle and automatically pours the molten metal in the mold;

a first carriage for transporting pouring ladle that can transport the pouring ladle along the casting line for mold; and a second carriage for transporting pouring ladle that transports the pouring ladle between the carriage for transporting treating ladle and the first carriage for transporting pouring ladle; and a device for control that controls each apparatus and component of the equipment for pouring molten metal.

4. The equipment for supplying molten metal from a melting furnace to an automatic pouring machine, according to claim 3, wherein the melting furnaces are present in a plurality numbers and wherein the melting furnaces and the apparatus for supplying alloy materials run in a line parallel to the casting line for mold.

5. The equipment for supplying molten metal from the melting furnace to the automatic pouring machine, according to claim 3 or 4, wherein the carriage for transporting treating ladle comprises a hoisting mechanism that is disposed on the carriage body, a tilting mechanism that is attached to the hoisting mechanism, and a mechanism for measuring weight that measures the weight of the molten metal in the treating ladle; and wherein the carriage for transporting treating ladle is movable along and between the apparatus for supplying alloy materials and the group of melting furnaces and movable on first rails that are laid in front of the apparatus for supplying alloy materials and the group of melting furnaces.

6. The equipment for supplying molten metal from the melting furnace to the automatic pouring machine, according to claim 3, wherein the apparatus for supplying alloy materials comprises:

four hoppers that each contain different kind of alloy material;

mechanisms for measuring weight are each attached to the outlet that is at the lower end of each hopper;

an opening and closing mechanism each attached to the lower surface of each of the mechanisms for measuring weight;

a conveyor belt installed right below the four opening and closing mechanisms, and extending along them; and a mechanism for supplying alloy materials installed at the position of discharge of the conveyor belt.

7. The equipment for supplying molten metal from the melting furnace to the automatic pouring machine, according to claim 3, wherein the automatic pouring machine comprises:

a carriage;

a mechanism for driving wheels that is attached to the carriage and that drives the wheels of the carriage;

a hoisting mechanism that is attached to the carriage and that can lift and lower the pouring ladle, the pouring ladle being placed on the carriage from which it is removable;

a tilting mechanism that is attached to the hoisting mechanism and that can tilt the pouring ladle;

a backward-and-forward moving mechanism that is attached to the carriage and that can move the hoisting mechanism and the tilting mechanism in the backward and forward directions that are perpendicular to the directions of the running of the carriage;

a mechanism for driving rollers that is attached to the carriage and that can move the pouring ladle backward and forward;

a mechanism for measuring weight that is attached to the carriage and that can measure the weight of the molten metal in the pouring ladle; and a mechanism for detecting position that can detect the position of the pouring ladle relative to the molding flasks of the casting line for mold.

8. The equipment for supplying molten metal from the melting furnace to the automatic pouring machine, according to claim 3, wherein the first carriage for transporting pouring ladle comprises a carriage body, a mechanism for driving wheels attached to the carriage body, and a mechanism for driving rollers attached to the carriage body, wherein the first carriage for transporting pouring ladle is movable on second rails that are laid along the automatic pouring machines and at the back of the automatic pouring machines and can move the pouring ladle backward and forward driven by a mechanism for driving rollers in the direction that is perpendicular to the second rails.

9. The equipment for supplying molten metal from the melting furnace to the automatic pouring machine, according to claim 3, wherein the second carriage for transporting pouring ladle comprises a carriage body, a mechanism for driving wheels attached to a carriage body, and driving rollers attached to the carriage body, wherein the second carriage for transporting pouring ladle is movable, driven by the mechanism for driving wheels, on third rails that are laid between the first rails and the second rails and in a direction that is perpendicular to the first rails and to the second rails, the thirds rails being laid in such a way that they connect the carriage for transporting treating ladle and the first carriage for transporting pouring ladle and wherein the pouring ladle, which is placed on driving rollers and which is removable from the driving rollers, is movable driven by the driving rollers in the direction of the third rails.

10. The equipment for supplying molten metal from the melting furnace to the automatic pouring machine, according to claim 3, wherein a device for control comprises circuits for the following:

when the molten metal in the treating ladle is all poured into the pouring ladle that has completed the pouring, calculating (1) the number of molds that the molten metal that remains in the pouring ladle of the second automatic pouring machine that is pouring can fill and (2) the number of molds that the molten metal that the pouring ladle that had completed the pouring of the molten metal received from the treating ladle can fill;

calculating the total number of molds that the molten metal can fill by adding the two numbers of molds that the molten metal can fill;

determining if the total number of molds that the molten metal can fill exceeds the number of molds on the casting line for mold that the molten metal is yet to fill;

if the total number of molds that the molten metal can fill is equal to or less than the number of molds in the casting line for mold that the molten metal is yet to fill, based on the total quantity of the molten metal that is to be poured and the number of molds on the casting line for mold that the molten metal is yet to fill, calculating the amount of the molten metal that should be supplied from the melting furnace to the treating ladle that has completed the pouring;

based on the result of the calculation, determining the target amounts of the four alloy materials that should be supplied from the apparatus for supplying alloy materials to the treating ladle that has completed the pouring;

determining if a change of material is necessary for the molten metal that is to be poured into the molds on the casting line for mold, which molds the molten metal is yet to fill;

if the change of material is necessary, recalculating the total amount of the molten metal that is to be poured before the change of material is carried out and after determining that the total amount is above the minimum amount of the molten metal that is scheduled to be poured, determining the target amounts for the four alloy materials;

if the total number of the molds that the molten metal can fill exceeds the number of the molds on the casting line for mold, which molds the molten metal is yet to fill, determining if the material of the molten metal that is to be poured into the scheduled number of molds of the next round is the same as the material of the molten metal that is being poured;

if the material of the molten metal that is to be poured into the scheduled number of molds of the next round is the same as the material of the molten metal that is being poured, based on the amount of the molten metal that is to be poured and the number of molds that the molten metal is yet to fill, calculating the amount of the molten metal that is below the capacity of the pouring ladle;

based on the result of this calculation, determining the calculated amounts for four kinds of alloy materials that are to be supplied from the apparatus for supplying alloy materials to the empty treating ladle; and if the material of the molten metal that is to be poured into the scheduled number of the molds of the next round differs from the material of the molten metal that is being poured, determining the target amounts of the four alloy materials after determining that the total amount of the molten metal that is to be poured exceeds the scheduled minimum total amount the molten metal that is to be poured.

* * * * *

UNITED STATES PATENT AND TRADEMARK OFFICE

CERTIFICATE OF CORRECTION

PATENT NO. : 8,886,349 B2
APPLICATION NO. : 13/378491
DATED : November 11, 2014
INVENTOR(S) : Toshiyuki Hyoudo et al.

It is certified that error appears in the above-identified patent and that said Letters Patent is hereby corrected as shown below:

On the Title Page

Item (57) Abstract, Line 1, "A supplying" should read as --A method of supplying--.

In the Claims

Claim 2, Col. 8, Line 61, "is yet" should read as --has yet--.

Claim 2, Col. 8, Line 64, "is yet" should read as --has yet--.

Claim 2, Col. 8, Line 67, "is yet" should read as --has yet--.

Claim 2, Col. 9, Lines 10-11, "is yet" should read as --has yet--.

Claim 2, Col. 9, Line 21, "is yet" should read as --has yet--.

Claim 2, Col. 9, Line 31, "is yet" should read as --has yet--.

Claim 10, Col. 11, Line 45, "is yet" should read as --has yet--.

Claim 10, Col. 11, Line 48, "is yet" should read as --has yet--.

Claim 10, Col. 12, Line 3, "is yet" should read as --has yet--.

Claim 10, Col. 12, Lines 13-14, "is yet" should read as --has yet--.

Claim 10, Col. 12, Line 24, "is yet" should read as --has yet--.

Claim 10, Col. 12, Line 34, "is yet" should read as --has yet--.

Signed and Sealed this
Ninth Day of June, 2015

Michelle K. Lee

Michelle K. Lee
*Director of the United States Patent and Trademark Office*